United States Patent [19]

Uemura et al.

[11] 4,303,027

[45] Dec. 1, 1981

[54] CLOTH FEEDING APPARATUS

[75] Inventors: Tamio Uemura, Kawasaki; Yoshimasa Ito; Takahiro Itakura, both of Yokohama, all of Japan

[73] Assignee: Tokico, Ltd., Kanagawa, Japan

[21] Appl. No.: 54,594

[22] Filed: Jul. 3, 1979

[30] Foreign Application Priority Data

Jul. 10, 1978 [JP] Japan ..... 53-83752
Jul. 10, 1978 [JP] Japan ..... 53-83753

[51] Int. Cl.[3] ..... D05B 27/14; D05B 27/16

[52] U.S. Cl. ..... 112/121.26; 112/313; 112/318

[58] Field of Search ..... 112/312, 313, 305, 317, 112/318, 322, 121.26, 121,11, 112/220, 275

[56] References Cited

U.S. PATENT DOCUMENTS

| | | | |
|---|---|---|---|
| 1,145,619 | 7/1915 | Seymour | 112/305 |
| 3,256,844 | 6/1966 | Chezaud et al. | 112/312 X |
| 3,382,827 | 5/1968 | Von Hagen | 112/317 X |
| 3,980,032 | 9/1976 | Kleinschmidt et al. | 112/121.11 X |
| 4,147,120 | 4/1979 | Adamski et al. | 112/318 |
| 4,187,795 | 2/1980 | Norton | 112/318 |

*Primary Examiner*—Peter P. Nerbun
*Attorney, Agent, or Firm*—Wegner & Bretschneider

[57] ABSTRACT

A cloth feeding apparatus having two feeding devices with respect to the feeding direction and adapted to feed a cloth under a tension by setting the feeding amount on the downstream greater than the feeding amount on the upstream.

11 Claims, 7 Drawing Figures

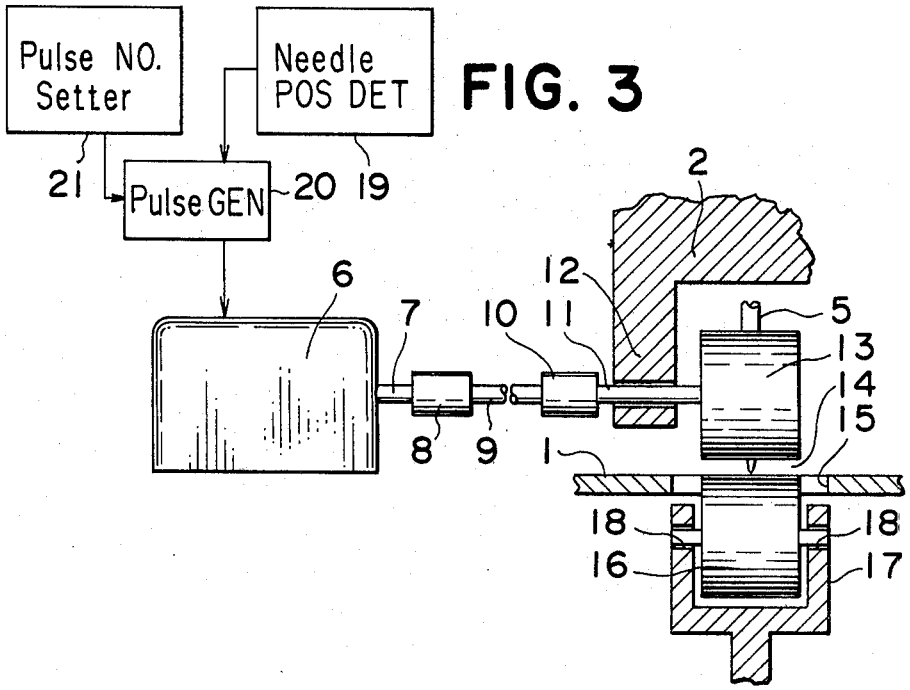
FIG. 3
FIG. 4
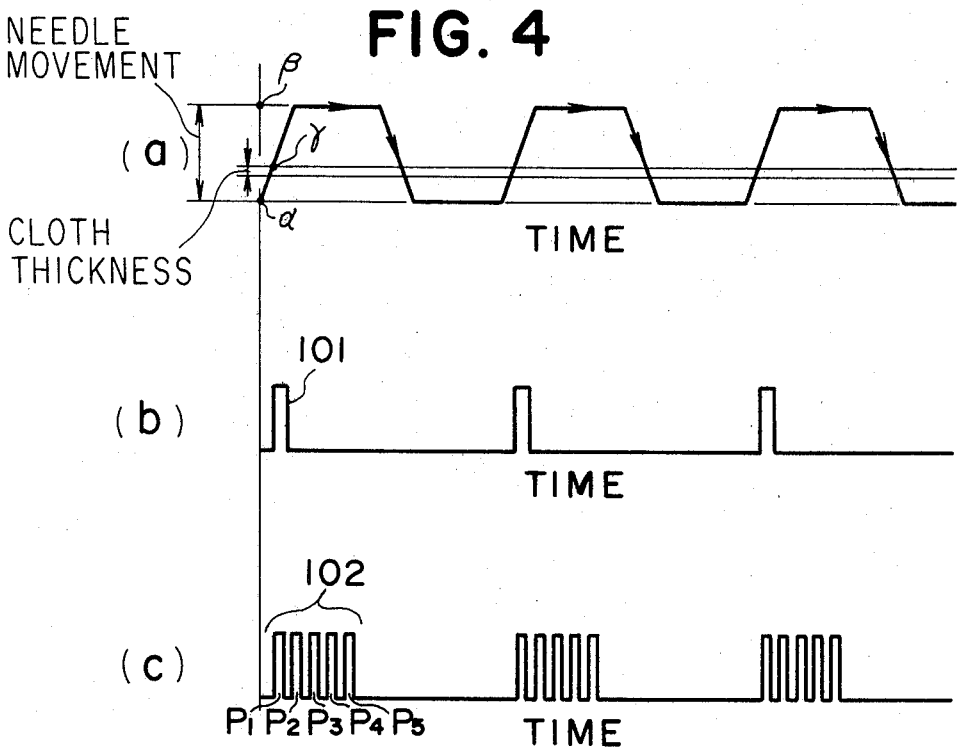

CLOTH FEEDING APPARATUS

This invention relates to an improvement in a cloth feeding apparatus for use in the sewing machines.

Sewing machines are generally provided with a cloth feeding apparatus adapted to feed a cloth in synchronization with the vertical movement of a needle and such cloth feeding apparatus is an indispensable component both in industrial sewing machines and domestic sewing machines.

While the feeding speed in the cloth feeding apparatus may be low in usual domestic sewing machines since the speed in the vertical movement of the machine needle is also low, industrial sewing machines may some time require a special auxiliary feeding device since the speed in the vertical movement of the needle is extremely higher as compared with that of the usual domestic sewing machine.

However, in such auxiliary cloth feeding apparatus of the conventional type, the rotation of the needle driving main shaft is first reduced in speed by reduction gearing and then converted into a swinging motion by a crank mechanism, and such swinging motion is again converted into a intermittent rotary motion by using a one-way clutch to rotate the cloth feed roller, so that when the up and down moving speed of the needle is increased to a very high level, the cloth feed roller might fail to make the normal intermittent rotary motion and would instead make a continuous motion owing to the inertia of the one-way clutch and the cloth feed roller, and as a result, the cloth might be fed while the needle is sticking into the cloth, causing break of the needle or other troubles.

In addition, the conventional auxiliary feeding device is also defective in that an excess load is applied, as the operation speed is increased, on the one-way clutch or the like by the inertia of the feed roller due to the intermittent movement of the feed roller, thus requiring frequent maintenance at a reduced interval for the entire cloth feeding apparatus.

The applicant of this invention has already proposed an electronic auxiliary feeding device of this type by the use of a step motor instead of the conventional speed reduction gears and the one-way clutch. In the auxiliary feeding device proposed by the applicant, a rotator is intermittently rotated by a step motor and a cloth is fed by the intermittent rotation of this rotator in cooperation with a known feeding device having a feed dog. The proposed auxiliary feeding device can not, however, effectively eliminate slippage puckering, seam puckering and the like resulted to the cloth in the sewing work since it feeds the cloths merely in combination with the feeding device having the feed dog or the like.

It is further desired for the cloth feeding apparatus that can feed the cloth forwardly and backwardly, by which sewn products of a good quality can be manufactured in a short time.

An object of this invention is to provide a cloth feeding apparatus which can improve the quality of sewn products, perform the sewing work in a short time, as well as can be applied to versatile uses.

Another object of this invention is to provide a cloth feeding apparatus which can eliminate the seam puckering such as small creases due to the difference in the expansion and contraction of sewing threads and cloths resulting during sewing work.

A further object of this invention is to provide a cloth feeding apparatus which can eliminate the mutual deviation between a cloth on the feed dog and another cloth on the pressure foot, that is, the slippage puckering resulted upon sewing a plurality of overlapped cloths.

A still further object of this invention is to provide a cloth feeding apparatus which can feed a cloth both forwardly and backwardly.

According to this invention, a cloth feeding apparatus is provided, in which two feeding devices capable of forward and backward feeding are provided with respect to the feeding direction, and the feeding device on the downstream is adapted to operate with a feeding amount greater than a feeding amount of the feeding device on the upstream, so that the cloth is fed under a tension in the forward feeding.

In a preferred embodiment, the feeding device on the upstream comprises a feed dog or the like for use with usual domestic sewing machines, in which a cloth is put between the feed dog and a pressure foot disposed opposing to the feed dog and fed by movement of the feed dog. A needle is disposed generally in parallel with a rod for supporting the pressure foot and extended together with the rod from the machine main body to the feed dog. It reciprocates, that is, moves vertically in synchronization with the movement of the feed dog and applies stitching to the cloth put between the feed dog and the pressure foot. The feed dog and the needle are actuated by a well-known actuation mechanism provided in the machine main body, and the main rotational shaft of the actuation mechanism is rotated by the rotation of a pulley secured to the main rotational shaft at one end of the machine main body.

In a preferred embodiment, the feeding device on the downstream comprises a pulse generator, a step motor actuated by a series of electric pulses applied from the pulse generator, a rotator in contact with the cloth rotated by the step motor. The pulse generator produces a series of electric pulses corresponding to the feeding amount of the cloth based on the withdrawal of the needle from the cloth. The pulse generator can be constituted with OR gates, AND gates, counter or the like and, preferably, with a known integrated logic circuit device. The number of pulses in the pulse train is determined in such a manner that the feeding amount given by the rotator is greater than the feeding amount given by the feeding device having the feed dog provided to the upstream of the rotator with respect to the feeding direction. For effectively eliminating the slippage puckering, seam puckering, and the like, it is desired to set the feeding amount of the feeding device on the downstream greater than that of the feeding device on the upstream by about 5–30% while the value may somewhat differ depending on the material of the cloth.

In a preferred embodiment of this invention, the feeding apparatus have a setting means capable of optionary setting the number of pulses in the pulse train generated from the pulse generator. The setting means can be mounted to the machine main body so as to be operated manually.

In a further embodiment of this invention, a same feeding amount is set to both of the feeding devices upon backward feeding, by which both of the feeding devices are operated so as to feed the cloth backwardly in the same feeding amount.

This invention is to be described by way of preferred embodiments thereof referring to the accompanying drawings, by which these and other objects, as well as advantageous features of this invention will be made more clear, wherein:

FIG. 3 is a detailed block diagram for the illustration of the electrical circuit of the cloth feeding apparatus shown in FIG. 1;

FIG. 4 is a waveform time chart in the electrical circuit of the cloth feeding apparatus shown in FIG. 3;

Figure 1:
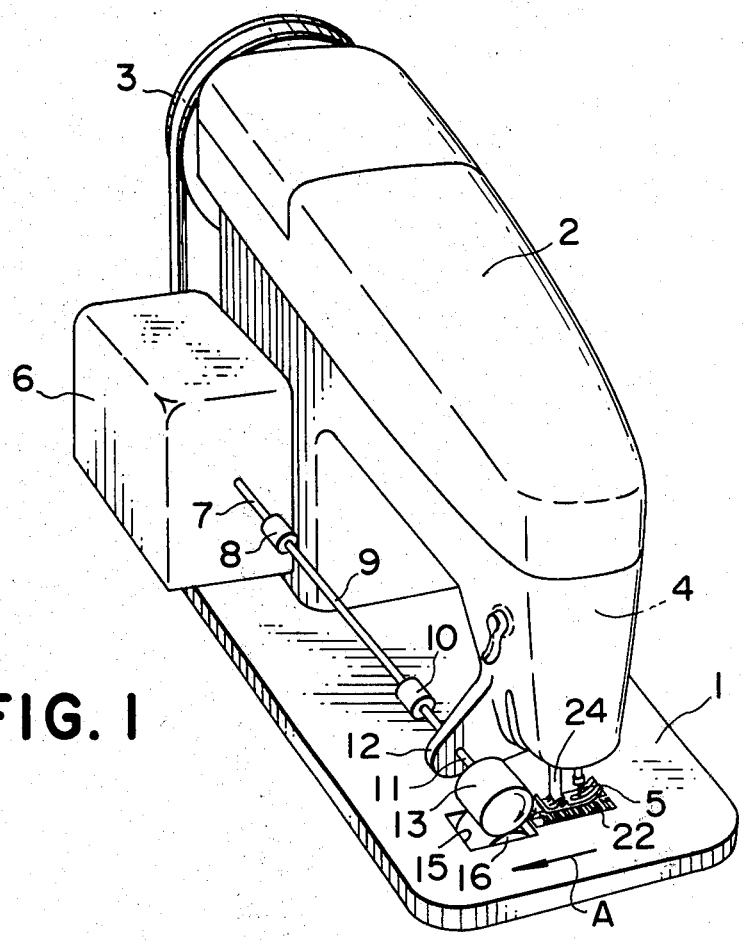
FIG. 1 is a perspective view of a sewing machine to which a preferred embodiment of the cloth feeding apparatus of this invention is applied.
Figure 2:
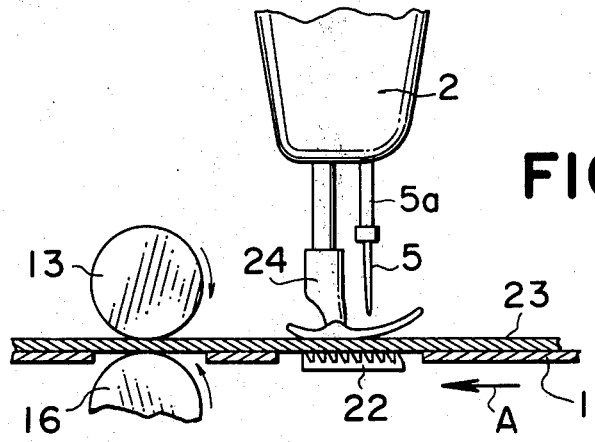
FIG. 2 is an explanatory view for the cross section of the sewing machine and the cloth feeding apparatus shown in FIG. 1.
Figure 5:
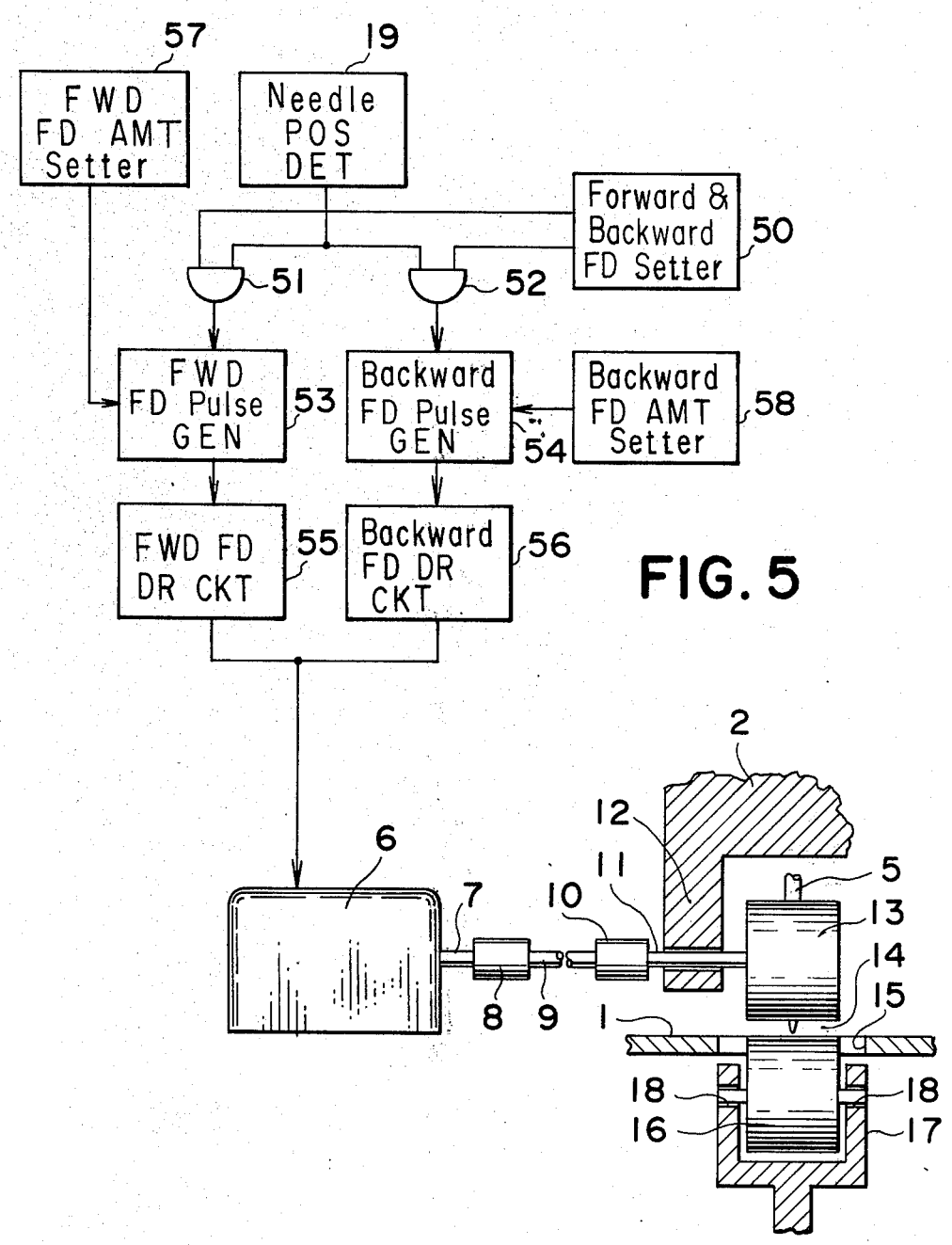
FIG. 5 is a detailed block diagram for the illustration of the electrical circuit of another preferred embodiment of the cloth feeding apparatus of this invention.
Figure 6:
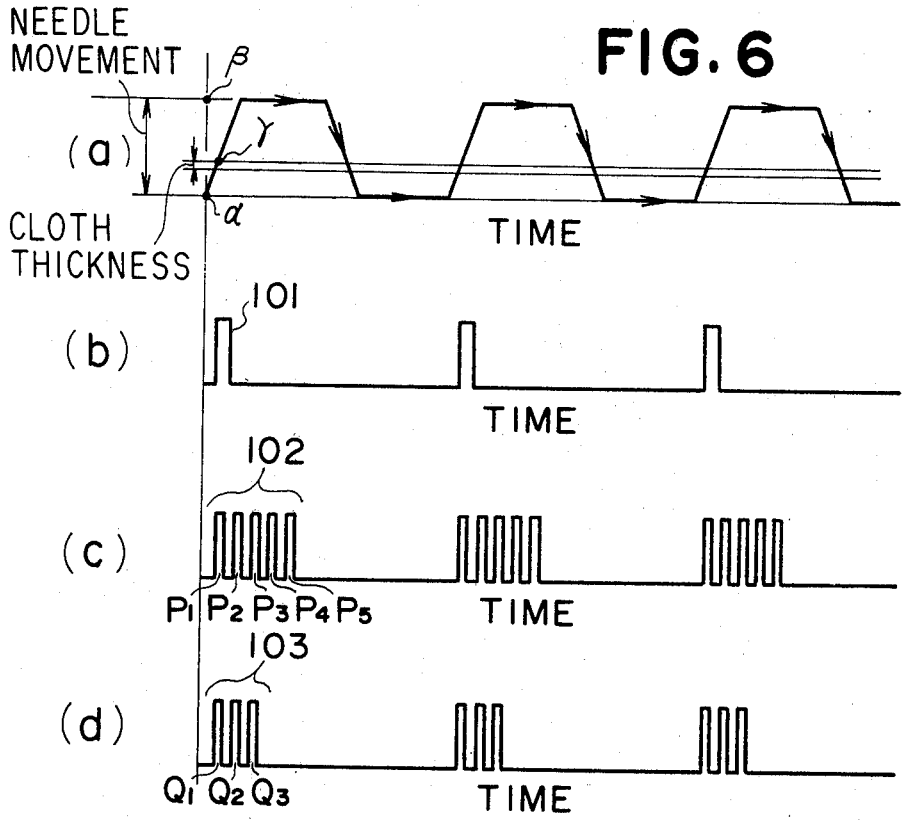
FIG. 6 is a waveform time chart in the electrical circuit of the cloth feeding apparatus shown in FIG. 5.

In FIG. 1 to FIG. 4, a sewing machine main body 2 is mounted on a bed 1, and a driving motor (not shown) for machine needle is provided under the bed 1 and the rotational force of the motor is transmitted to a pulley 3. A known conversion mechanism 4 (the details thereof being not shown) for converting the rotational movement of the pulley 3 into reciprocal movement is provided to the machine main body 2 and a needle 5 is moved vertically by the conversion mechanism 4.

A step motor 6 is provided securely to the machine main body 2 and the output shaft 7 of the step motor 6 is connected by way of a universal joint 8 to a rod 9 and then by way of a universal joint 10 to a rotational shaft 11.

The rotational shaft 11 is rotatably supported to the machine main body 2 by way of a journal 12 secured to the machine main body 2. The rotational shaft 11 is provided with a roller 13 as a rotator, and the roller 13 is disposed in close adjacency to the bed 1 so as to form a gap 14 between the lower surface of the roller 13 and the bed 1 for allowing a cloth 23 to pass therethrough. The roller 13 may be substituted with an endless belt as the rotator and any other means can also be used so long as the cloth may be fed while put between such a rotator and the bed 1. The needle 5 is disposed close to the roller 13 in such a manner that it is situated at a distance of about $\frac{1}{2}$ width of the roller 13.

A pressure roller 16 is provided so as to be partially situated in an opening 15 formed in the bed 1 opposing to the roller 13. The pressure roller 16 is adapted to press the cloth in cooperation with the roller 13. A supporting member 17 for the pressure roller 16 is formed with holes 18, 18 for pivotally supporting the shaft of the pressure roller 16.

While on the other hand, the position of the needle 5 is always detected by a needle position detector 19 and the needle position detector 19 is adapted to supply one electric signal pulse to a driving pulse generator 20 upon leaving of the needle 5 from the cloth. The needle position detector 19 is constituted with a phototransistor, a light emission diode and the like so that it detects the position of the needle 5 by the vertical movement of a rod 5*a* to which the needle 5 is attached or by the rotational movement of a rotational shaft (not shown) connected to the pulley 3 for driving the needle 5.

The driving pulse generator 20 supplies a series of electric pulses to the step motor 6 upon receiving the output signal from the needle position detector 19. Since the rotational amount of the output shaft 7 of the step motor, that is, a unit feeding amount per one pulse is predetermined, when the output shaft 7 of the step motor 6 is rotated by the pulse train from the driving pulse generator 20, the cloth is fed by a predetermined amount corresponding to the number of pulses. A pulse number setter 21 can set the number of pulses in the pulse train issued from the driving pulse generator 20 and the feeding amount in one feed cycle can be set in an equivalent manner by the adjustment of the pulse number setter 21. Accordingly, the pulse number setter 21 is provided to the machine main body 2 or the like so as to be operated manually. A feed dog 22 of another feeding device having a similar structure to that used in the domestic sewing machines is provided just beneath the needle 5 and to the upstream of the roller 13 with respect to the feeding direction A of the cloth 23. A pressure foot 24 for another feeding device having the feed dog 22 is disposed near the needle 5 and holds the cloth 23 in combination with the feed dog 22. Another feeding device is capable of forward and backward feeding and the feed dog 23 is operated in an approximate synchronization with the feeding operation of the roller 13, although the driving mechanism or the like for another feeding device is known itself and not detailed here.

The cloth feeding apparatus having the foregoing constitution operates as described below.

The needle 5 leaves the cloth 23 at a point $\gamma$ in the course of its vertical movement from the lower dead point $\alpha$ to the upper dead point $\beta$. Then, the needle position detector 19 issues an electric pulse 101. The pulse number setter 21 determines the number of pulses in the pulse train issued from the driving pulse generator 20 so as to set the feeding amount of the roller 13 greater than the feeding amount of the feed dog 22 in the cloth feeding along the direction A. Consequently, the driving pulse generator 20, triggered by the pulse 101, issues a pulse train 102 consisting of, for example, five pulses $P_1$–$P_5$ determined as above while the needle 5 is being withdrawn from the cloth 23. When the pulse train 102 is issued from the driving pulse generator 20, the output shaft 7 of the step motor 6 is rotated corresponding to the number of pulses in the pulse train 102 and, thereby, the roller 13 connected to the output shaft 7 is also rotated corresponding to the number of pulses in the pulse train 102. Therefore, the cloth 23 now tends to be forwardly fed by the roller 13 by the foregoing feeding amount set at the pulse number setter 21. Then, simultaneously, the feed dog 22 of another feeding device also forwardly feeds the cloth 23 along the feeding direction A in corporation with the pressure foot 24. By the way, since the feeding amount of the feed dog 22 is set to a value corresponding to the feeding amount, for example, by four shots of the pulses and, accordingly, it is smaller than the feeding amount by the roller 13, the cloth 23 is slightly pulled toward the roller 13 in this forward feeding and applied with a tension between the roller 13 and the pressure foot 24. More specifically, since the roller 13 tends to feed the cloth 23 at a feeding amount greater than that set for the feed dog 22 while the feed dog 22 tends to feed the cloth 23 at a feeding amount smaller than that set for the roller 13, the feeding amount to the cloth 23 is different between the position on the roller 13 and the position on the feed dog 22 and the cloth 23 is stretched between the positions for the roller 13 and the feed dog 22. After the completion of such cloth feeding operation, the needle 5 is inserted through the cloth 23 and the same operation is repeated when the needle 5 leaves the cloth 23 again, by which the cloth 23 is sewn successively. Issue of the pulse train is not necessarily be limited only to the period in which the needle 5 is away from the cloth 23 but it can continue to be issued over such an adequate period after the insertion of the needle 5 through the cloth that the needle 5 may not be flexed. Thus, by setting the feeding amount of the cloth feeding device provided on the downstream greater than the feeding amount of the cloth feeding device provided on the upstream with respect to the feeding direction in the forward feeding of the cloth, a tension is applied to the cloth between the roller and the pressure foot, which can eliminate the seam puckering such as small creases due to the difference in the expansion and contraction of the sewing threads and the cloth resulted upon sewing work. In addition, while a deviation between cloths on the feed dog 22 and cloths on the pressure foot 24, that is, the slippage puckering would be resulted upon sewing a plurality of overlapped cloths if the plurality of cloths are fed only by means of the feed dog 22, such disadvantage can be prevented by the above constitution and thereby the quality of the sewed products can be improved.

Another embodiment of this invention is to be explained referring to FIG. 1 and FIG. 2, and FIG. 5 and FIG. 6, in which the same parts or portions as those in the foregoing embodiment are shown by corresponding reference numerals and the detailed explanation therefor is omitted.

In the drawing, a forward and backward feed setter 50 is constituted with a switch provided to the machine main body 2 so as to be operated manually. AND gates 51 and 52 are adapted to put to close and open by electric logic signals from the setter 50, in which a pulse from a detector 19 is transmitted at the output upon opening of the gate and the pulse from the detector 19 is inhibited from producing at the output upon closure of the gate. Upon receiving the pulse from the detector 19, a forward feed driving pulse generator 53 or a backward feed driving pulse generator 54 issues a pulse train corresponding to the feeding amount in one feed cycle while the needle 5 leaves the cloth. A forward feed driving circuit 55 operates on the pulse train from the generator 53 so as to rotationally drive the reversible pulse motor 6 forwardly while, on the other hand, a backward feed driving circuit 56 operates on the pulse train from the generator 54 so as to rotationally drive the pulse motor 6 backwardly. The generator 54 and the driving circuit 56 constitute a backward feed circuit. A forward feeding amount setter 57 determines the number of pulses in the pulse train issued from the generator 53 in one forward feed cycle, that is, it determines the feeding amount of a cloth to be fed forwardly in one forward feed cycle. While on the other hand, a backward feeding amount setter 58 determines the number of pulses in the pulse train issued from the generator 54 in one backward feed cycle, that is, it determines the feeding amount of a cloth to be fed backwardly in one backward feed cycle. These setters 57 and 58 are constituted with a digital switch or the like provided to the machine main body 2 so as to be operated manually.

Referring then to the operation of the electronic cloth feeding device capable of forward and backward feeding constituted as foregoings, when the needle 5 leaves the cloth at a point $\gamma$ in the course of its vertical movement from the lower dead point $\alpha$ to the upper dead point $\beta$. Then, the detector 19 issues a pulse 101. Assuming here that a forward feeding (that is, the feeding in the forward direction A) is set in the setter 50, since the gate 51 is opened and another gate 52 is closed, the pulse 101 is supplied to the generator 53. While the generator 53, triggered by the above pulse 101, issues a pulse train corresponding to the sewing pitch, that is, a cloth feeding amount in one feed cycle, the feeding amount if adapted to be set optionally to a desired amount by the setter 57 and the number of pulses in the pulse train is determined based on the value set by the setter 57. Consequently, if a feeding amount, for example, corresponding to five pulses is set in the setter 57, the generator 53 issues a pulse train 102 consisting of five pulses $P_1$–$P_5$. When the pulse train 102 is supplied to the driving circuit 55, the driving circuit 55 operates so as to rotationally drive the step motor 6 forwardly. Accordingly, the output shaft 7 of the step motor 6 is rotated corresponding to the number of pulses in the pulse train 102 and, thereby, the roller 13 connected to the output shaft 7 is also rotated corresponding to the number of pulses in the pulse train 102 and the cloth tends to be fed in the forward direction A with the feeding amount set by the setter 57. Upon the forward feeding, the number of pulses in the pulse train is determined in such a way that the cloth can be fed with the feeding amount greater than the forward feeding amount of the feed dog 22 of the another cloth feeding device provided on the upstream. In this case, the forward feeding amount of the feed dog 22 is set to a value corresponding to the cloth feed amount of the roller 13 given, for example, by three pulses, by which a tension is applied to the cloth between the feed dog 22 and the roller 13 and, thereby, the generation of slippage puckering, seam puckering and the like can be prevented. Then, when the backward feeding (in the direction opposite to the forward feeding direction A) is set in the setter 50, it turns the gate 51 to be close and the gate 52 to be open, and the pulse 101 from the detector 19 is now supplied to the generator 54. Consequently, in the same manner as foregoings, the generator 54, triggered by the pulse 101, issues a pulse train based on the value set on the setter 58. Therefore, assuming here that a feeding amount corresponding, for example, to three pulses is set in the setter 58, the generator 54 issues a pulse train 103 consisting of three pulses $Q_1$–$Q_3$. It is preferred here to equalize the feeding amount set as above to the backward feeding amount of the feed dog 22. Thus, when the pulse train 103 is issued from the generator 54 and supplied to the driving circuit 56, the driving circuit 56 operates so as to rotationally drive the step motor 6 reversely. Accordingly, the output shaft 7 of the step motor 6 is rotated corresponding to the number of pulses in the pulse train 103 and, thereby, the roller 13 connected to the output shaft 7 is also rotated corresponding to the number of pulses in the pulse train 103 and the cloth is fed backwardly with the feeding amount set by the setter 58.

Figure 7:
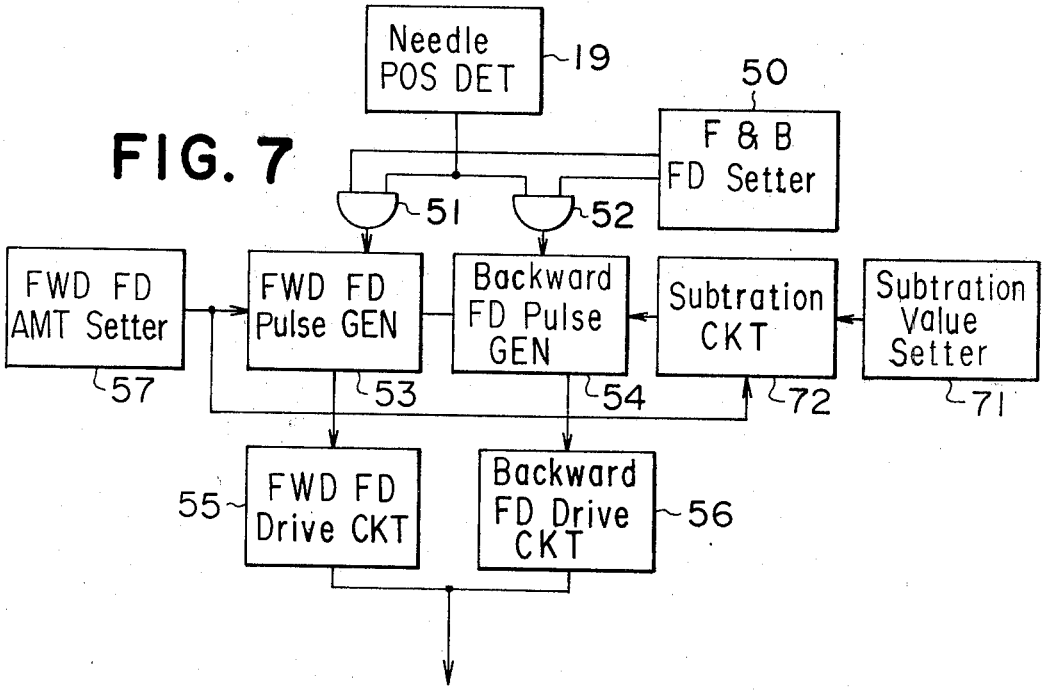
FIG. 7 is a detailed block diagram for the illustration of electrical circuit of a still further preferred embodiment of the cloth feeding apparatus of this invention.

Alternatively, the foregoing backward feeding amount setter 58 may be constituted as shown in FIG. 7. In FIG. 7, a subtraction value setter 71 which determines, upon backward feeding, a subtraction value in the feeding amount relative to that in the forward feeding is constituted with a digital switch or the like provided to the machine main body as in the setter 58. The output from a subtraction circuit 72 which subtracts the amount set in the setter 71 from the amount set in the setter 57 is supplied to the generator 54. Accordingly, the generator 54 issues a pulse train as in the foregoing manner based on the output from the subtraction circuit 72.

Also in this embodiment, the pulse train is not necessarily be issued only within a period while the needle 5 is away from the cloth and it can be kept to issue for a further suitable period after the insertion of the needle 5 through the cloth again unless the needle 5 is not flexed.

What is claimed is:

1. A cloth feeding apparatus, comprising first and second feeding devices capable of forward and backward feeding, wherein said first feeding device comprises a rotator provided on the downstream to the second feeding device with respect to the forward feeding direction for feeding the cloth in contact therewith, a pulse generator for generating a series of pulses corresponding to the cloth feeding amount in response to the withdrawal, from the cloth, of a needle provided reciprocally movably so as to stitch the cloth on a bed, a step motor actuated by the series of pulses from the pulse generator, said step motor causing said rotator to rotate, and a feeding amount setter adapted to determine the number of the pulses in said series issued from the pulse generator, upon the forward feeding operation, in such a manner that the feeding amount of the rotator is greater than the feeding amount of the second feeding device provided on the upstream to the rotator with respect to the forward feeding direction, whereby the cloth is fed under tension during forward cloth feeding.

2. The cloth feeding apparatus as claimed in claim 1, in which both of the feeding devices are adapted to operate at the same feeding amount during backward cloth feeding.

3. The cloth feeding apparatus as claimed in claim 1, in which said feeding amount setter is capable of setting the forward and backward feeding amounts.

4. The cloth feeding apparatus as claimed in claim 1, in which the cloth feeding amount setter is capable of setting a forward feeding amount, said first feeding device further comprising a subtraction value setter capable of setting, upon backward cloth feeding, an amount to be subtracted from the forward feeding amount set by the feeding amount setter, and a subtraction circuit for subtracting the subtraction amount set on the subtraction value setter from the forward feeding amount set on the feeding amount setter.

5. The cloth feeding apparatus as claimed in claim 1, which comprises, provided on the machine main body, a forward feeding amount setter capable of setting a forward feeding amount, a subtraction value setter capable of setting, upon backward cloth feeding, an amount to be subtracted from the feeding amount set by the forward feeding amount setter, and a subtraction circuit for subtracting the subtraction amount set on the subtraction value setter from the forward feeding amount set on the forward feeding amount setter.

6. The cloth feeding apparatus as claimed in claim 5, in which the feeding device on the downstream comprises a pulse generator for generating a series of pulses corresponding to the feeding amount in response to the withdrawal, from a cloth, of a needle provided reciprocally movably so as to stitch the cloth on the bed, a step motor actuated by the series of pulses from the pulse generator, and a rotator in contact with the cloth actuated by the step motor, and the forward feeding amount setter is adapted to determine the number of series of pulses issued from the pulse generator, upon forward feeding, in such a manner that the feeding amount of the rotator is greater than the feeding amount of the feeding device provided to the upstream of the rotator with respect to the feeding direction, and the subtraction circuit is adapted to determine the number of series of pulses issued from the pulse generator so as to equalize the feeding amounts of both of the feeding devices to each other upon backward feeding.

7. The cloth feeding apparatus as claimed in claim 4, in which the subtraction circuit is adapted to determine the number of pulses in said series issued from the pulse generator so as to equalize the feeding amounts of both of the feeding devices to each other upon backward feeding.

8. The cloth feeding apparatus as claimed in any one of claims 1 to 7, in which the feeding amount of the first feeding device is greater than the feeding amount of the second feeding device by 5–30 percent upon forward feeding.

9. The cloth feeding apparatus as claimed in any one of claims 1 or 7, in which said pulses are generated from the pulse generator in such a way that the rotator is kept to continue its rotation even after the needle has been inserted through the cloth upon forward feeding.

10. The cloth feeding apparatus as claimed in any one of claims 1 to 7, in which the rotator is a roller.

11. The cloth feeding apparatus as claimed in any one of claims 1 to 7, in which the rotator is an endless belt.

* * * * *

UNITED STATES PATENT AND TRADEMARK OFFICE

CERTIFICATE OF CORRECTION

PATENT NO. : 4,303,027

DATED : December 1, 1981

INVENTOR(S) : Tamio UEMURA ET AL

It is certified that error appears in the above—identified patent and that said Letters Patent is hereby corrected as shown below:

On the title page,

Item [73] Assignee:, please change

"Tokico, Ltd., Kanagawa, Japan" to

--Tokyo Juki Industrial Co., Ltd.,
Tokyo, Japan--

Signed and Sealed this

*Thirteenth* Day of *July 1982*

[SEAL]

*Attest:*

GERALD J. MOSSINGHOFF

*Attesting Officer*

*Commissioner of Patents and Trademarks*